US012228133B2

(12) United States Patent
Cargill

(10) Patent No.: US 12,228,133 B2
(45) Date of Patent: Feb. 18, 2025

(54) ROTARY POSITIVE DISPLACEMENT PUMP WITH A GUARD

(71) Applicant: ALFA LAVAL CORPORATE AB, Lund (SE)

(72) Inventor: Simon Cargill, Eastbourne (GB)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 18/260,493

(22) PCT Filed: Jan. 19, 2022

(86) PCT No.: PCT/EP2022/051071
§ 371 (c)(1),
(2) Date: Jul. 6, 2023

(87) PCT Pub. No.: WO2022/157168
PCT Pub. Date: Jul. 28, 2022

(65) Prior Publication Data

US 2024/0052831 A1 Feb. 15, 2024

(30) Foreign Application Priority Data

Jan. 19, 2021 (EP) ..... 21152412
Jun. 8, 2021 (EP) ..... 21178353

(51) Int. Cl.
*F04C 2/18* (2006.01)
*F01C 17/02* (2006.01)
(Continued)

(52) U.S. Cl.
CPC ..... *F04C 2/18* (2013.01); *F01C 17/02* (2013.01); *F04C 13/00* (2013.01); *F04C 15/0061* (2013.01)

(58) Field of Classification Search
CPC ..... F04C 2/18; F04C 13/00; F04C 15/0061; F01C 17/02
See application file for complete search history.

(56) References Cited

U.S. PATENT DOCUMENTS 3,129,010 A * 4/1964 Stratienko ..... B01F 27/71 134/194
5,199,317 A * 4/1993 Moore ..... F16H 57/0434 184/6.12
(Continued)

FOREIGN PATENT DOCUMENTS

CN 205638911 U 10/2016
CN 208651134 U 3/2019
(Continued)

OTHER PUBLICATIONS

English Translation DE-102012104736-B4 (Year: 2012).*
(Continued)

*Primary Examiner* — Shafiq Mian
(74) *Attorney, Agent, or Firm* — BUCHANAN INGERSOLL & ROONEY PC

(57) ABSTRACT

A rotary positive displacement pump comprises a transmission housing having front and rear walls and rotationally supporting first and second drive shafts having constantly meshing gears such that the drive shafts rotate in opposite directions. A rotor casing connected to a front side of the housing has rear and front walls and a circumferential side wall defining an interior pumping cavity. The casing houses first and second rotors drivingly connected to the first and second drive shafts to provide a positive pumping effect on fluid product entering the cavity. The front and rear walls of the housing define an intermediate space through which the drive shafts extend. A first guard is located in the intermediate space and surrounds the drive shafts, or first and second guards are located in the intermediate space and
(Continued)

surround the first and second drive shafts respectively, for protecting a person from contacting the drive shafts.

19 Claims, 9 Drawing Sheets

(51) Int. Cl.
*F04C 13/00* (2006.01)
*F04C 15/00* (2006.01)

(56) References Cited

U.S. PATENT DOCUMENTS

2009/0304540 A1* 12/2009 Whittome ..... F04C 15/0038 415/230
2012/0328462 A1 12/2012 Helgeson et al.
2015/0064043 A1* 3/2015 Kemp ..... F01C 21/108 418/261
2019/0234403 A1* 8/2019 Crocker ..... B05C 11/10

FOREIGN PATENT DOCUMENTS

DE 102012104736 A1 12/2013
DE 102012104736 B4 * 2/2016 ..... F04C 13/002

OTHER PUBLICATIONS

European Search Report dated Nov. 29, 2021 in corresponding European Application No. EP 21 17 8353.
International Search Report (PCT/ISA/210) and Written Opinion (PCT/ISA/237) mailed on May 16, 2022, by the European Patent Office as the International Searching Authority for International Application No. PCT/EP2022/051071.
Office Action (Notice of Reasons for Rejection) issued on May 7, 2024, in corresponding Japanese Patent Application No. 2023-543181 and English translation of the Office Action. (11 pages).

* cited by examiner

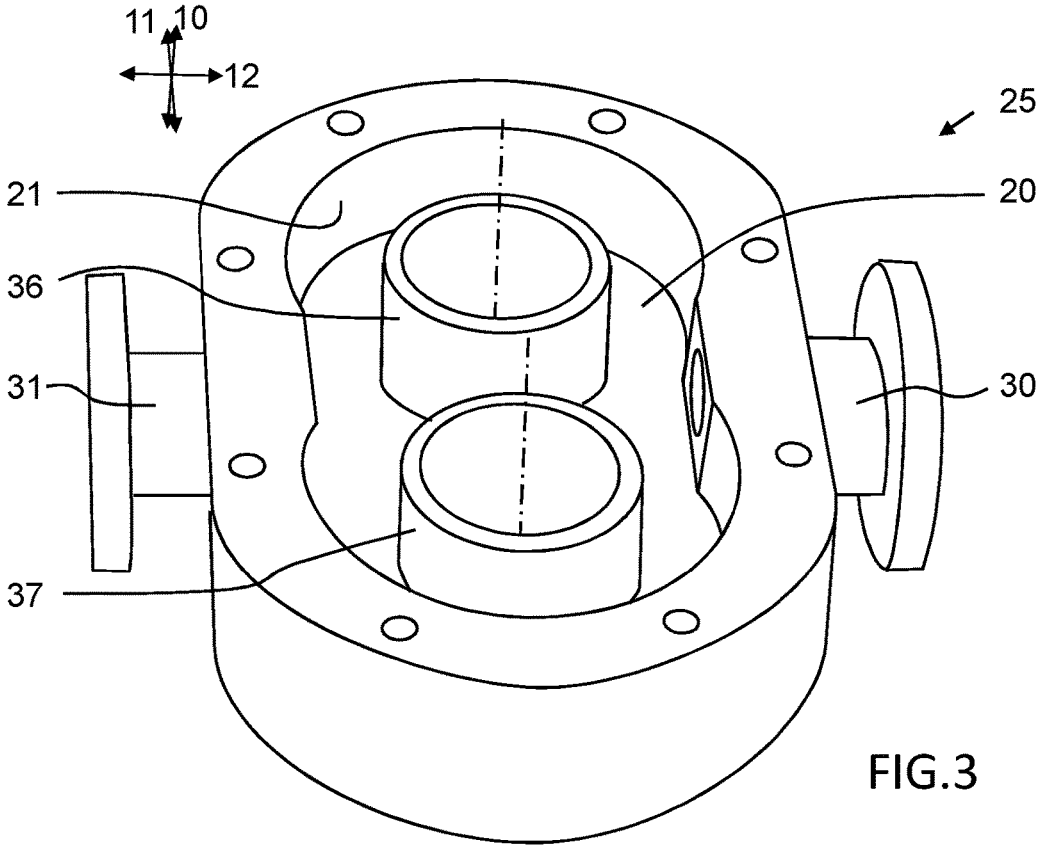
FIG.3
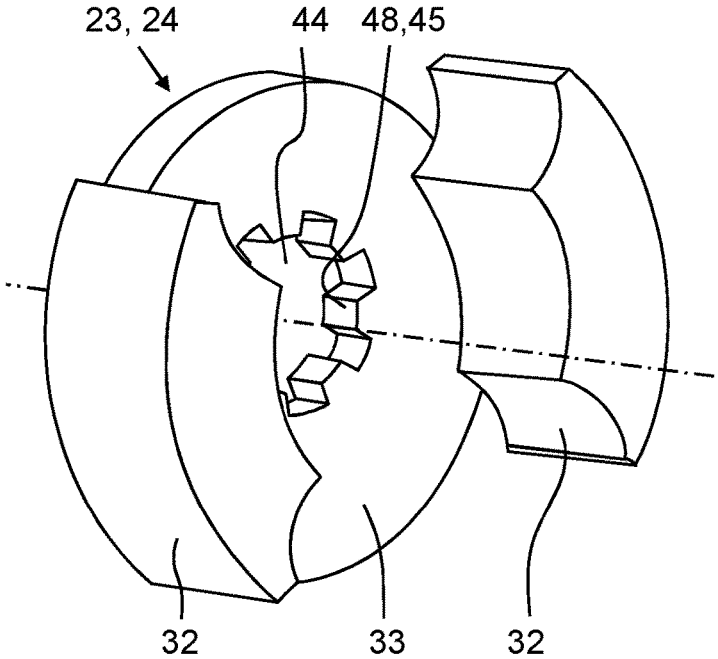
FIG.4
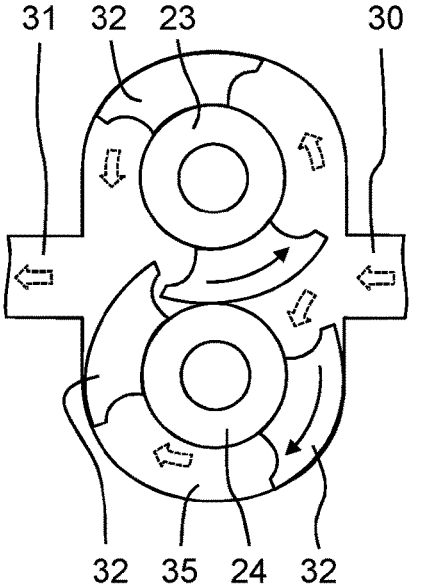
FIG.5
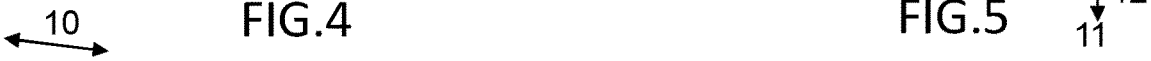

ROTARY POSITIVE DISPLACEMENT PUMP WITH A GUARD

TECHNICAL FIELD

The present disclosure relates to a rotary positive displacement pump. The rotary positive displacement pump according to the disclosure will be described primarily in terms of circumferential piston pump, but the pump according to the disclosure is not restricted to this particular type of pump, but may alternatively be implemented in terms of rotary lobe pump, a gear pump, or the like.

BACKGROUND

In the field of rotary positive displacement pumps, health and safety regulations require the exposed areas of the drive shafts between the rotor casing and transmission housing to be suitably guarded to prevent injury of a person, such as for example a worker, technician, janitors, or the like. Conversely, to comply with industry hygiene regulations part of the drive shaft must be exposed or visible so that seal leakage at the drive shaft can be quickly identified.

A known solution involves fitting guards to the external surfaces of the pump for covering the complete area between rotor casing and transmission housing. However, this approach may sometimes require complete temporary removal of the guards for detecting a small drive shaft seal leakage. Another disadvantage with this method is that fluid products leaking from a drive shaft seal may solidify and build-up in the enclosed area creating hygiene risks and potentially compromising the transmission housing oil seals.

The prior art guards can be easily removed, lost and damaged and it is not uncommon for end users to remove the guard completely to give permanent visibility to the seal area, thus defeating the whole purpose of fitting the guard.

Guards fitted to the external pump surfaces and covering the intermediate space between rotor casing and transmission housing can create further challenges. For example, pumps fitted with flushable drive shaft seals need a suitable flush media connection, but pre-cutting the guard to allow fitting of flush connections can infringe the health and safety requirements when unflushed drive shaft seals are fitted. Similarly, pumps fitted with rotor casing heating/cooling also need a suitable heating/cooling medium connection, but pre-cutting the guard to allow fitting of heating medium connections can infringe the health and safety requirements when unflushed drive shaft seals are fitted.

This means that different guard designs may be necessary depending on what type of seal is fitted to the pump and whether rotor casing heating/cooling is implemented, thereby significantly increasing cost and complexity associated with designing, manufacturing, distributing, and spare part handling of guards for the pump.

There is thus a need for an improved rotary positive displacement pump in terms of cost-efficiency and user-friendliness.

SUMMARY

An object of the present disclosure is to provide a rotary positive displacement pump where the previously mentioned problems are avoided. This object is at least partly achieved by the features of the independent claim. The dependent claims contain further developments of the rotary positive displacement pump.

According to a first aspect of the present disclosure, there is provided a rotary positive displacement pump for pumping a fluid product. The pump having a front side and a rear side and comprising: a transmission housing having an axial front wall and an axial rear wall and providing rotational support to first and second parallel and axially extending drive shafts having gears in constant mesh condition, such that the first and second drive shafts are arranged to rotate in opposite directions; and a rotor casing connected to a front side of the transmission housing and having an axial rear wall, an axial front wall and a circumferential side wall jointly defining a stationary interior pumping cavity. The rotor casing houses a first rotor that is drivingly connected to the first drive shaft and a second rotor that is drivingly connected to the second drive shaft, and the first and second rotors are configured for rotating in opposite directions and mutually interacting for providing a positive pumping effect on a fluid product that enters the pumping cavity via a rotor casing inlet and exits the pumping cavity via a rotor casing outlet. The axial front wall of the transmission housing and the axial rear wall of the rotor casing jointly define an intermediate space through which the first and second drive shafts extend, and the rotary positive displacement pump further comprises a first guard located in said intermediate space and surrounding the first drive shaft for protecting a person from contacting the first drive shaft, and a second guard located in said intermediate space and surrounding the second drive shaft for protecting a person from contacting the second drive shaft.

There is also provided a rotary positive displacement pump for pumping a fluid product. The pump having a front side and a rear side and comprising: a transmission housing having an axial front wall and an axial rear wall and providing rotational support to first and second parallel and axially extending drive shafts having gears in constant mesh condition, such that the first and second drive shafts are arranged to rotate in opposite directions; and a rotor casing connected to a front side of the transmission housing and having an axial rear wall, an axial front wall and a circumferential side wall jointly defining a stationary interior pumping cavity. The rotor casing houses a first rotor that is drivingly connected to the first drive shaft and a second rotor that is drivingly connected to the second drive shaft, and the first and second rotors are configured for rotating in opposite directions and mutually interacting for providing a positive pumping effect on a fluid product that enters the pumping cavity via a rotor casing inlet and exits the pumping cavity via a rotor casing outlet. The axial front wall of the transmission housing and the axial rear wall of the rotor casing jointly define an intermediate space through which the first and second drive shafts extend, and the rotary positive displacement pump further comprises a first guard located in said intermediate space and surrounding the first drive shaft and a second guard located in said intermediate space and surrounding the second drive shaft. This protects a person from contacting the first drive shaft and the second drive shaft.

According to a second aspect of the present disclosure, there is provided a rotary positive displacement pump for pumping a fluid product as described above, but wherein the rotary positive displacement pump instead of first and second guards comprises a single first guard located in said intermediate space and surrounding the first and second drive shafts for protecting a person from contacting the first and second drive shafts.

There is also provided a rotary positive displacement pump for pumping a fluid product as described above, but wherein the rotary positive displacement pump instead of first and second guards comprises a single first guard located in said intermediate space and surrounding the first and second drive shafts. This protects a person from contacting the first and second drive shafts.

In this way, a pump with a new type of guard is provided, wherein the new guard enables the guard to be position closer to the shaft allowing access to seal flushing connections and other optional pump features while keeping the same guard, such that a cost-efficient pump is provided. Hence, the new pump is more user-friendly because the guard does not have to be dismounted and re-mounted at service etc. As a result, the risk that pump is operated without a guard is reduced.

Further advantages are achieved by implementing one or several of the features of the dependent claims.

In some example embodiments, the first guard, or each of the first and second guards, is made of curved sheet metal, specifically stainless steel, and preferably includes integral attachment tabs. Thereby, a robust guard is accomplished.

In some example embodiments, that may be combined with any one or more of the above-described embodiments, the first guard, or each of the first and second guards, is fastened to the front wall of the transmission housing. Thereby, a concealed mounting and compact guard is provided, and removal of the guard is made more difficult for increased safety.

In some example embodiments, that may be combined with any one or more of the above-described embodiments, the first guard, or each of the first and second guards, is fastened to the front wall of the transmission housing by a plurality of fastening members having their longitudinal direction arranged parallel with an axial direction of the first and second drive shafts. This also enables a more concealed mounting and compact guard is provided, and removal of the guard is made more difficult for increased safety.

In some example embodiments, that may be combined with any one or more of the above-described embodiments, a cross-section of the first guard, or each of the first and second guards, as seen in a radial direction of the pump and in a region free from a guard attachment device, may have a length in the axial direction and a thickness in the radial direction, wherein said length is at least three times larger, specifically five times larger, and more specifically at least ten times larger, than said thickness. As a result, a sleek guard is provided that does not occupy much space.

In some example embodiments, that may be combined with any one or more of the above-described embodiments, a radial distance between an outer surface of the first or second drive shaft and a radially outer surface of a protective body of the first guard, or any of the first and second guards, over at least 50%, specifically at least 75%, of the circumference of the first guard or first and second guards, does not exceed 50%, specifically does not exceed 30%, of the diameter of the first drive shaft, in an axial region where the first guard overlaps with the first drive shaft. The guard is thus mounted relatively deep and concealed in the intermediate space, thereby being consistent with a large variety of pump configurations.

In some example embodiments, that may be combined with any one or more of the above-described embodiments, a radial distance between an outer surface of the transmission housing and a protective body of the first guard, or any of the first and second guards, is larger than 50% of the diameter of the first drive shaft, in an axial region where the first guard overlaps with the first drive shaft. The guard is thus mounted relatively deep and concealed in the intermediate space, thereby being consistent with a large variety of pump configurations.

In some example embodiments, that may be combined with any one or more of the above-described embodiments, a protective body of the first guard, or each of the first and second guards that surrounds the first and/or second drive shafts is made in one piece. Thereby a robust and cost-efficient design is accomplished.

In some example embodiments, that may be combined with any one or more of the above-described embodiments, a protective body of the first guard, or each of the first and second guards that surrounds the first and/or second drive shafts is made of a plurality of parts, specifically two parts, which are assembled next to each other. This design may simplify mounting and dismounting when needed.

In some example embodiments, that may be combined with any one or more of the above-described embodiments, the rotary positive displacement pump further comprises a first outer end plate for securing a roller bearing of the first drive shaft to the transmission housing, and a second outer end plate for securing a roller bearing of the second drive shaft to the transmission housing, wherein said first and second outer end plates are attached to the transmission housing by means of the same fastening members as used for attaching the first guard, or the first and second guards, to the transmission housing. As a result, fewer parts are required for manufacturing the pump.

In some example embodiments, that may be combined with any one or more of the above-described embodiments, a protective body of the first guard, or each of the first and second guards, is axially displaced from an abutment surface of a guard attachment device, such that a first axial gap is provided between the protective body and a front surface associated with the front wall of the transmission housing, and/or from a rear surface of the rear wall of the rotor casing, such that a second axial gap is provided between the protective body and the rear wall of the rotor casing, for enabling improved visibility of the first and second drive shafts, and for enabling improved detection of leakage of a fluid product and/or transmission oil at a drive shaft seal associated with the first guard, or any of the first and second guards. These example embodiments may be worded as that a protective body of the first guard, or each of the first and second guards, is axially displaced from an abutment surface of the guard attachment device and/or a rear surface of the rear wall of the rotor casing, such that a first axial gap is provided between the protective body and a front surface associated with the front wall of the transmission housing and a second axial gap between the protective body and the rear wall of the rotor casing for enabling improved visibility of the first and second drive shafts, and for enabling improved detection of leakage of a fluid product and/or transmission oil at a drive shaft seal associated with the first guard, or any of the first and second guards.

In some example embodiments, that may be combined with any one or more of the above-described embodiments, a protective body of the first guard, or each of the first and second guards, is axially displaced from an abutment surface of a guard attachment device, such that a first axial gap is provided between the protective body and a front surface associated with the front wall of the transmission housing, and/or from a rear surface of the rear wall of the rotor casing, such that a second axial gap is provided between the protective body and the rear wall of the rotor casing. This enables improved visibility of the first and second drive shafts. This also enables improved detection of leakage of a fluid product and/or transmission oil at a drive shaft seal associated with the first guard, or any of the first and second guards. These example embodiments may be worded as that a protective body of the first guard, or each of the first and second guards, is axially displaced from an abutment surface of the guard attachment device and/or a rear surface of the rear wall of the rotor casing, such that a first axial gap is provided between the protective body and a front surface associated with the front wall of the transmission housing and a second axial gap between the protective body and the rear wall of the rotor casing. This enables improved visibility of the first and second drive shafts. This also enables improved detection of leakage of a fluid product and/or transmission oil at a drive shaft seal associated with the first guard, or any of the first and second guards.

In some example embodiments, that may be combined with any one or more of the above-described embodiments, each of the first and second axial gaps is at least 5 millimetres, specifically in the range of 5-10 millimetres. This enables leak detection while avoiding that a person unintentionally may come into contact with the drive shaft.

In some example embodiments, that may be combined with any one or more of the above-described embodiments, a protective body of the first guard, or each of the first and second guards, comprises recesses and/or through holes for enabling improved visibility of the first drive shaft or first and second drive shafts, and for enabling improved detection of leakage of a fluid product and/or transmission oil at a drive shaft seal associated with the first guard, or any of the first and second guards.

In some example embodiments, that may be combined with any one or more of the above-described embodiments, a protective body of the first guard, or each of the first and second guards, comprises recesses and/or through holes. This enables improved visibility of the first drive shaft or first and second drive shafts. This also enables improved detection of leakage of a fluid product and/or transmission oil at a drive shaft seal associated with the first guard, or any of the first and second guards.

In some example embodiments, that may be combined with any one or more of the above-described embodiments, the first and second guard have identical design. This enables improved overall cost-efficiency of the pump.

In some example embodiments, that may be combined with any one or more of the above-described embodiments, the first guard, or each of the first and second guards, has a protective body. This enables a compact guard design combined with a robust structure as well as a simple and cost-efficient design. The protective body may surround the first and/or second drive shafts.

In some example embodiments, that may be combined with any one or more of the above-described embodiments, the first guard, or each of the first and second guards, has a plurality of guard attachment devices. This enables a compact guard design combined with a robust structure as well as a simple and cost-efficient design. The guard attachment devices may extend from the protective body. The guard attachment devices may be clamped to the front wall of the transmission housing or an intermediate member.

In some example embodiments, that may be combined with any one or more of the above-described embodiments, each of the first and second guards has an annular protective body. This enables a compact guard design combined with a robust structure as well as a simple and cost-efficient design. The annular protective body may have a sleeve-like shape.

In some example embodiments, that may be combined with any one or more of the above-described embodiments, each of the first and second guards has a plurality of guard attachment devices. This enables a compact guard design combined with a robust structure as well as a simple and cost-efficient design. The guard attachment devices may extend from the annular protective body. The guard attachment devices may be clamped to the front wall of the transmission housing.

In some example embodiments, that may be combined with any one or more of the above-described embodiments, each of the first and second guards has an annular protective body with sleeve-like shape and a plurality of guard attachment devices extending from the annular protective body and clamped to the front wall of the transmission housing. This enables a compact guard design combined with a robust structure as well as a simple and cost-efficient design.

Further features and advantages of the invention will become apparent when studying the appended claims and the following description. The skilled person in the art realizes that different features of the present disclosure may be combined to create embodiments other than those explicitly described hereinabove and below, without departing from the scope of the present disclosure.

BRIEF DESCRIPTION OF DRAWINGS

The rotary positive displacement pump according to the disclosure will be described in detail in the following, with reference to the attached drawings, in which FIG. 3 shows schematically a perspective view of a rotor casing rear portion according to an example embodiment of the pump, FIG. 4 shows schematically a perspective view of an example embodiment of a rotor of the pump, FIG. 5 shows schematically a principle of pumping operation according to an example embodiment of the pump.

DESCRIPTION OF EXAMPLE EMBODIMENTS

Various aspects of the disclosure will hereinafter be described in conjunction with the appended drawings to illustrate and not to limit the disclosure, wherein like designations denote like elements, and variations of the described aspects are not restricted to the specifically shown embodiments, but are applicable on other variations of the disclosure.

Figure 1:
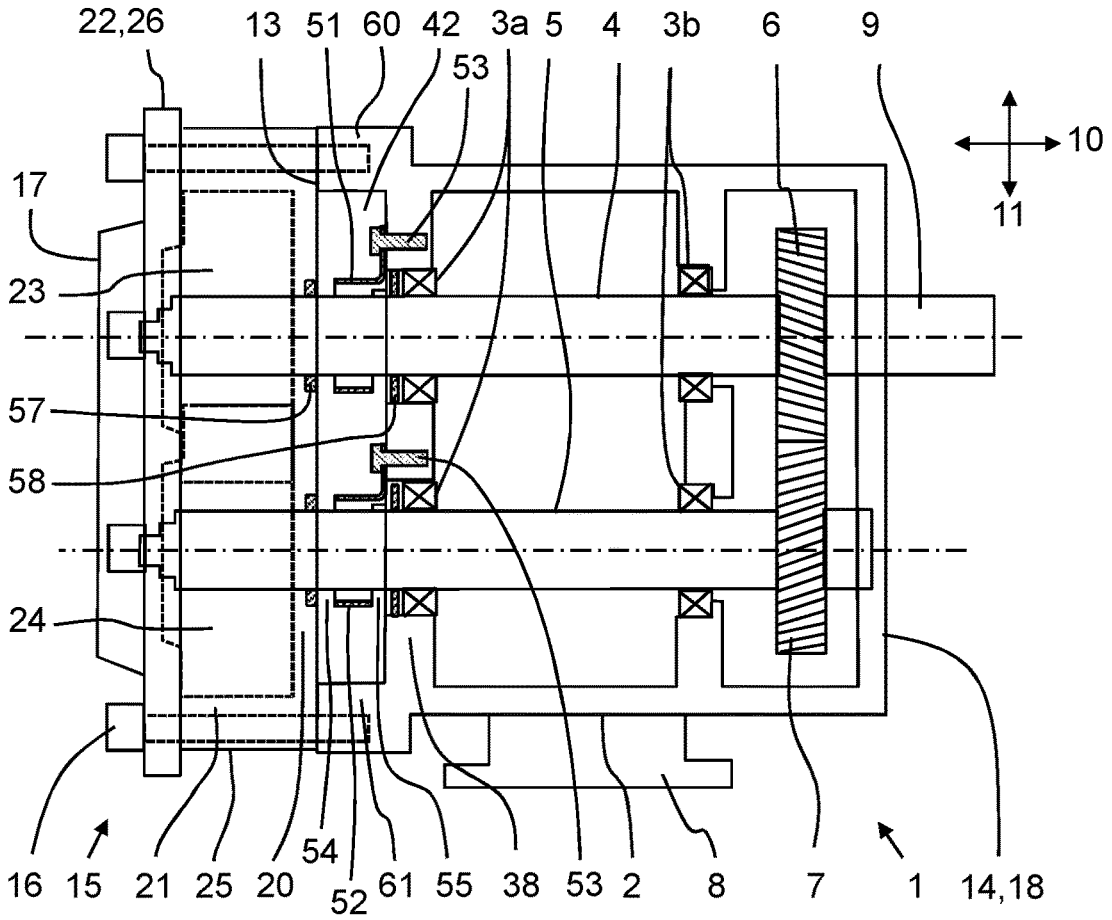
FIG. 1 shows schematically a side-view of an example embodiment of the pump.

FIG. 1 schematically shows a side view of a first example embodiment of the rotary positive displacement pump 1 for pumping a fluid product according to the disclosure. The pump 1 has a transmission housing 2 including rotational support 3*a*, 3*b* to first and second parallel drive shafts 4, 5, which extend in an axial direction 10 of the pump 1. The rotational support 3*a*, 3*b* may for example, for each of the first and second drive shafts 4, 5, be provided in form of front side annular rolling bearing 3*a* and rear side annular rolling bearing 3*b*, both fastened to the transmission housing 2 and rotationally holding the first and second drive shaft 4, 5, respectively.

The first axially extending drive shaft 4 carries a first gear 6 and the second axially extending drive shaft 5 carries a second gear 7. The first and second gears 6, 7, i.e. gear wheels, are arranged in constant mesh condition, meaning that they are in constant gear engagement with each other. Moreover, since the first and second gears 6, 7 are in directing engagement with each other they rotate in opposite directions.

Figure 2:
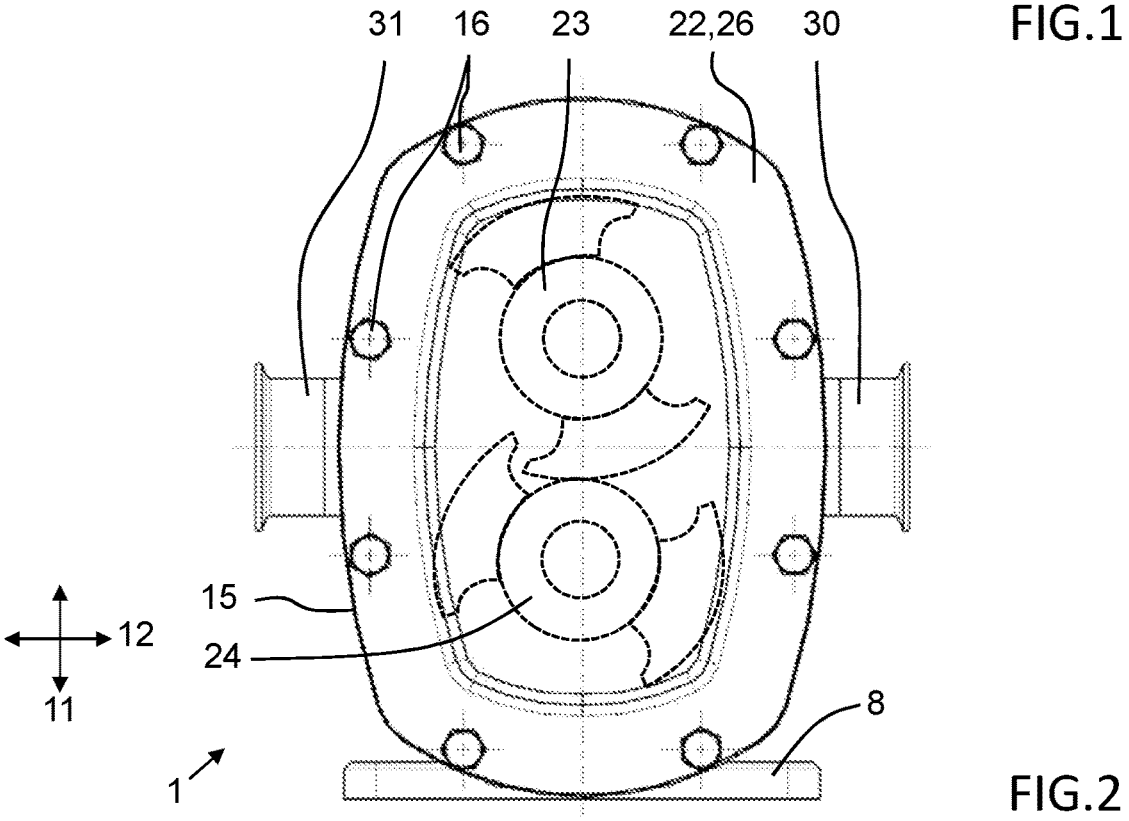
FIG. 2 shows schematically a front-view of an example embodiment of the pump.

The transmission housing 2 has a first length in the axial direction 10, a second length in a first lateral direction 11 that is perpendicular to the axial direction 10, and a third length in a second lateral direction 12 that is perpendicular to both the axial direction and the first lateral direction 11, as shown in FIG. 2. The pump is also defined in terms of a radial direction 19, which herein refers to any direction that is perpendicular to the axial direction 10. Both the first and second lateral directions 11, 12 are thus also radial directions.

The transmission housing further has a front side 13 and a rear side 14, as seen in the axial direction 10.

An end portion 9 of one of the first and second drive shafts 4, 5, such as for example the first drive shaft 4, may extend out through a wall of the transmission housing 2 at the rear side of the transmission housing 2 for rotational connection with a rotational torque source, such as for example a motor, for powering the pump 1.

The transmission housing 2 may be made of metal, such as for example stainless steel, cast iron, steel or aluminium alloy, and the first and second drive shafts 4, 5 may be made of steel.

The transmission housing 2 may additionally include a support structure 8 for enabling attachment of the transmission housing 2 to an exterior support surface, for example by means of threaded bolts or other type of fasteners. The transmission housing may be made in one piece or composed of multiple sub-parts.

In the example embodiment of the pump illustrated in FIG. 1, the pump 1 further comprises a rotor casing 15 connected to the transmission housing 2 at the front side 13 of the transmission housing 2. The rotor casing 15, which for example is made of stainless steel, may be removably fastened to the front side 13 of the transmission housing 2 via a suitably fastening arrangement. For example, the rotor casing 15 may be clamped against the front side 13 of the transmission housing 2 by means of a plurality of threaded bolts or nuts 16 or similar threaded members.

The assembled pump 1 including the transmission housing 2 and the rotor casing 15 has a front side 17 and a rear side 18, and a front view of the pump 1 of FIG. 1 is schematically shown in FIG. 2, wherein first and second rotors 23, 24 located within the rotor casing 15 are illustrated with dotted lines.

As can be seen in FIG. 2, the plurality of threaded bolts or nuts 16 used for clamping the rotor casing 15 may extending through the entire rotor casing 15 and by visible from the front side 17 of the pump 1.

In the example embodiment of FIGS. 1 and 2, the rotor casing 15 comprises an axial rear wall 20, a circumferential side wall 21 and an axial front wall 22, which jointly defines a closed stationary interior pumping cavity.

Since the rotor casing 15 houses first and second rotors 23, 24 located within the interior pumping cavity, the rotor casing 15 is openable for enabling access to the interior pumping cavity. In the example embodiment of FIGS. 1 and 2, this access is made possible by making the rotor casing 15 in two parts: a rotor casing rear portion including the axial rear wall 20 and circumferential side wall 21 of the rotor casing 15, and a separate front cover 26 acting as the axial front wall 22 of the rotor casing 15, wherein the removable front cover 26 is removably fastened to the rotor casing rear portion 5 by a suitable attachment arrangement.

A schematic 3D view of an example embodiment of a rotor casing rear portion 25 according to the disclosure is provided in FIG. 3, as seen partly from a front side of the rotor casing rear portion 25.

The removable front cover 26 may be clamped against the rotor casing rear portion by means of the same plurality of threaded bolts or nuts 16 that are used for clamping the rotor casing 15 against the front side 13 of the transmission housing 2. Alternatively, separate attachment arrangements may be provided for attaching the front cover 26 to the rotor casing rear portion 25.

In the example embodiment of FIGS. 2-3, the rotor casing 15 further includes a fluid product inlet opening 30 for enabling a fluid product to enter, e.g. being sucked into, the interior pumping cavity, and a fluid product outlet opening 31 for enabling the fluid product to exit, e.g. being pumped out of, the interior pumping cavity.

As mention above, the rotor casing 15 furthermore houses the first and second rotors that are configured for generating the pumping functionality of the pump. The first rotor 23 is rotationally fastened to a front end of the first drive shaft 4 and the second rotor 24 is rotationally fastened to a front end of the second drive shaft 5. Consequently, the first and second rotors 23, 24 are configured to rotate in mutually opposite directions, as illustrated by arrows in FIG. 5.

An example embodiment of the first and second rotors 23, 24, which may have substantially identical design, are schematically illustrated in FIGS. 1 and 2, and a 3D view of an example embodiment of one of the first and second rotors 23, 24, as seen partly from a rear side, is provided in FIG. 4.

Each of the first and second rotors 23, 24 has at least one, and preferably a plurality of, rotor wings 32 and a rotor drive element 33 that is configured to be mounted torque proof on a rotor seat of an associated drive shaft 4, 5.

The rotor drive element 33 of each rotor 23, 24 may be substantially disc-shaped or sleeve-shaped and including a central hole or recess 44 for mounting on the associated drive shaft 4, 5. The hole or recess 44 may be defined by a cylindrical mounting surface 48 having splines 45, or by a non-circular mounting surface for enabling torque proof mounting of the rotor on the rotor seat of the associated drive shaft 4, 5.

With reference to FIG. 5, in this example embodiment of the pump 1, during operation of the pump 2, the first and second rotors 23, 24 are configured to rotate in opposite directions with the same rotational speed. The first and second rotors 23, 24 are configured to define a pumping volume within a space 35 restricted by the neighbouring rotor wings of the same rotor and the walls 20, 21, 22 of the interior pumping cavity. Moreover, during rotation of the first and second rotors 23, 24, the fluid product is configured to be conveyed from the fluid product inlet opening 30, along an outer side of each rotor 23, 24 and to the fluid product outlet opening 31, illustrated by the arrows in FIG. 5.

In particular, when the rotor wings (pistons) 32 rotate around the circumference of the pumping cavity, they continuously generates a partial vacuum at the product inlet opening 30 as the first and second rotors 23, 24 unmesh, causing fluid product to enter the pump 1. The fluid product is subsequently transported around the pumping cavity by the rotor wings 32. A direction of flow generated by the pump 1 is reversible by simply shifting the direction of rotation of the first and second rotors 23, 24.

The specific form and number of rotor wings 32 may vary considerably and the specific rotor twin-wing design illustrated in FIGS. 2, 4 and 5 is merely one example embodiment of rotor wings, and the pump may thus have rotors 23, 24 with other types of rotor wing designs according to the disclosure.

With reference to FIG. 3, the rotor casing 15 may comprise a first cylindrical rotor case hub 36 extending from the rear wall 20, and a second cylindrical rotor case hub 37 extending from the rear wall 20. The first and second hubs 36, 37 are essentially hollow cylindrical sleeves that are open towards both axial sides thereof. Moreover, an axial direction of each cylindrical hub 36, 37 is aligned with the axial direction 10 of the pump 1.

The first rotor case hub 36 is configured to receive the first drive shaft 4, and the second rotor case hub 37 is configured to receive the second drive shaft 5. In other words, in an assembled state, the first rotor case hub 36 is aligned with the first drive shaft 4, and the second rotor case hub 37 is aligned with the second drive shaft 5. The first and second hubs 36, 37 are thus displaced from each other in the first lateral direction 11.

Prior to assembly of the transmission housing 2 with the rotor casing 15, the front ends of the first and second drive shafts 4, 5 protrude forwards beyond the front surface 13 of the transmission housing. Subsequently, upon assembly of the transmission housing 2 with the rotor casing 15, said front ends of the first and second drive shafts 4, 5 are inserted from a rear side into the first and seconds hubs, respectively, and a rear side of the rotor casing 15 comes into contact with the front surface 13 of the transmission housing 2. In this state, the front ends of the first and second drive shafts 4, 5 extend through the complete axial length of the first and seconds hubs 36, 37.

With reference to FIG. 1, according to some example embodiments, the pump comprises rotor casing seal 57 configured to prevent leakage of a fluid product from the pumping cavity to the intermediate space 42 along of the first or second drive shaft 4, 5. Similarly, according to some example embodiments, the pump comprises a transmission housing seal 58 configured to prevent leakage of transmission oil from the transmission housing to the intermediate space 42 along of the first or second drive shaft 4, 5.

Figure 6:
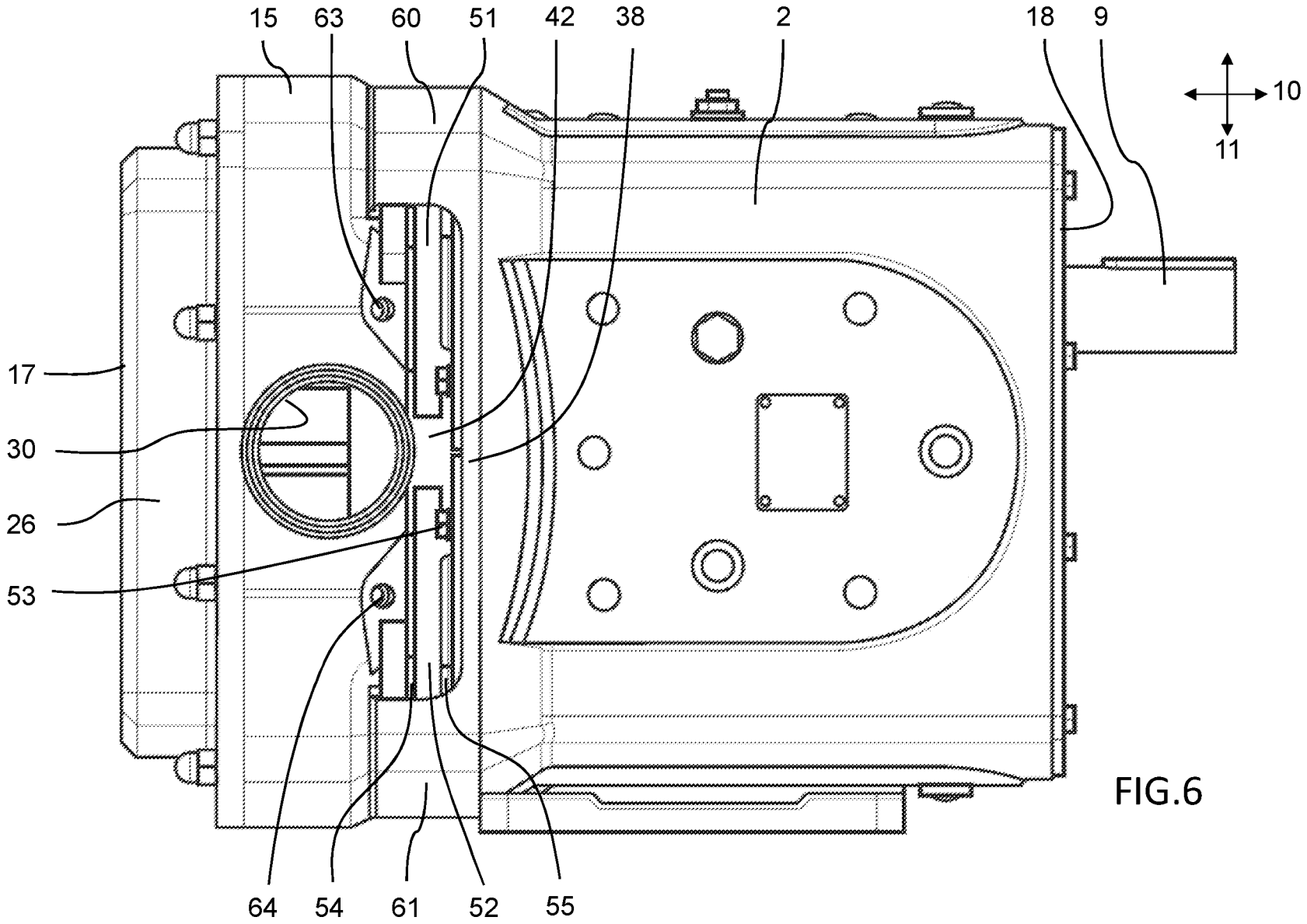
FIG. 6 shows schematically a further side-view of an example embodiment of the pump.
Figure 7:
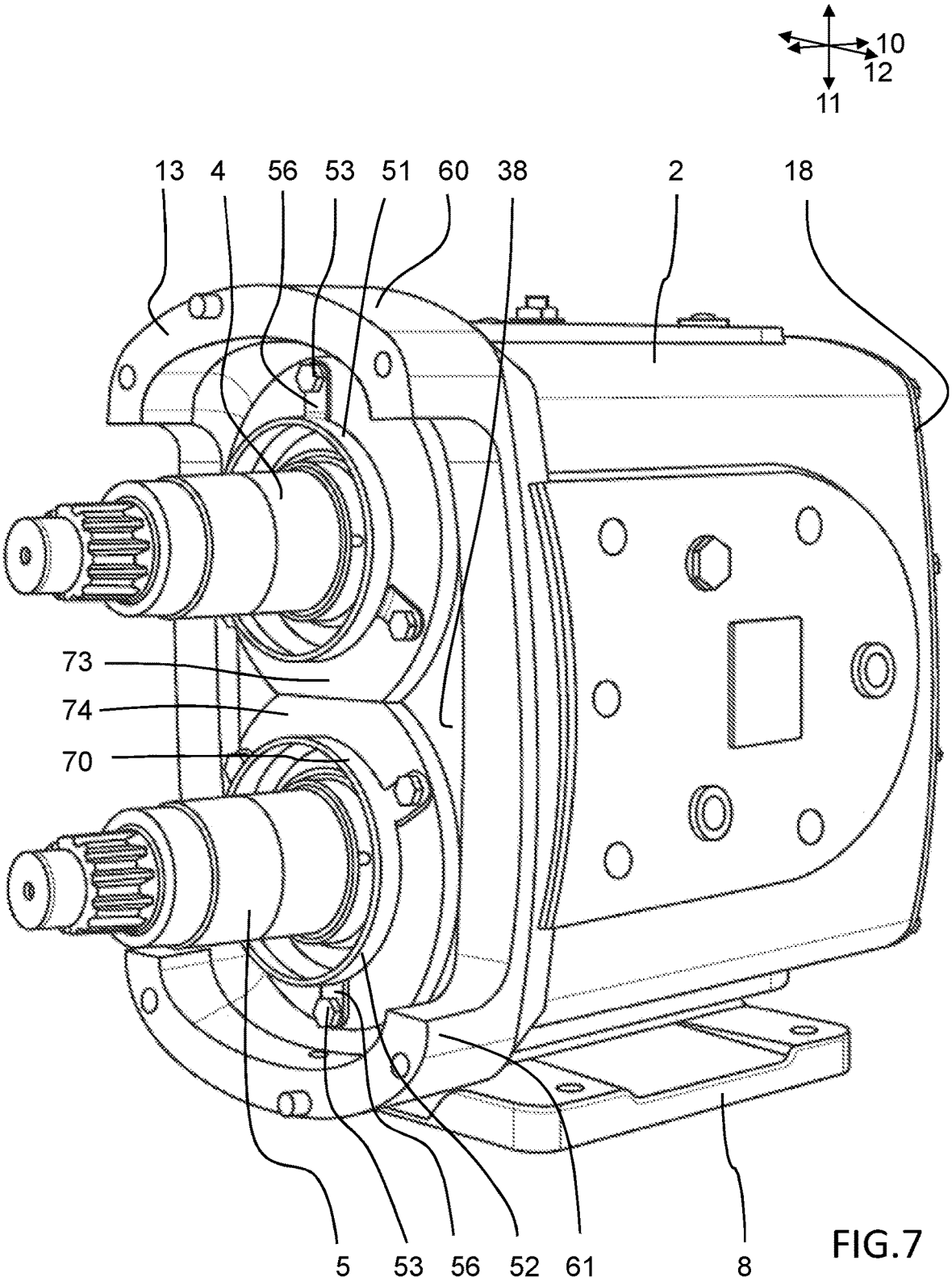
FIG. 7 shows schematically a perspective view of the transmission housing according to an example embodiment of the pump.

FIG. 6 shows a side-view of an example embodiment of the pump 1, and FIG. 7 shows a side view of the same pump 1 but with the rotor casing 15 dismounted.

With reference to FIGS. 1, 6 and 7, the transmission housing 2 may for include first and second axially protruding attachment portions 60, 61 facing the rotor casing 15 and located on opposite sides of the drive shafts 4, 5. The rotor casing 15 may then be connected to the front side 13 of the transmission housing 2 via said first and second axially protruding attachment portions 61, 62, such that an intermediate space 42 is accomplished between the front wall 38 of the transmission housing 2 and the rear wall 20 of the rotor casing 25.

The first and second axially protruding attachment portions 60, 61 are only provided at two opposite sides of the transmission housing 2, such that access to the intermediate space 42 is possible from the second lateral sides 12, as illustrated in FIGS. 1 and 6.

In the example embodiment of FIG. 1, the pump is free from rotary casing heating and free from seal flushing connections, thereby providing a relatively empty intermediate space 42. For ensuring that a person, such as a worker, a technician or a janitor or the like does not unintentionally comes in contact with a rotating first or second drive shaft 4, 5, during operation of the pump 1, an individual and separate first guard 51 is provided in said intermediate space 42 and surrounding the first drive shaft 4 for protecting a person from contacting the first drive shaft 4, and an individual and separate second guard 52 is provided in said intermediate space 42 and surrounding the second drive shaft 5 for protecting a person from contacting the second drive shaft 5.

Each of the first and second guards 51, 52 is fastened to the front wall 38 of transmission housing 2 by a plurality of fastening members 53 having their longitudinal direction arranged parallel with an axial direction 10 of the first and second drive shafts 4, 5. Thereby, removal of the first and second guards 51, 52 by a user is typically complicated or even impossible without first detaching the rotor casing 15 from the pump 1. Consequently, the risk that the pump 1 is operated without the guards properly mounted is reduced, thereby improving user-friendliness.

The fastening members 53 may for example be a threaded component, such as for example a screw, nut or bolt. Furthermore, the fastening members 53 may be inserted through holes or recesses formed in guard attachment devices 56, such as integral attachment tabs 56, of each of the first and second guards 51, 52.

Each of the first and second guards 51, 52 are designed and mounted to provide a first axial gap 54 of at least 5 millimetres, specifically an axial gap in the range of 5-10 millimetres, between a protective body of each of the first and second guards 51, 52 and the rear wall of the rotor casing.

Similarly, each of the first and second guards 51, 52 are designed and mounted to provide a second axial gap 55 of at least 5 millimetres, specifically an axial gap in the range of 5-10 millimetres, between the protective body of each of the first and second guards 51, 52 and the front wall 38 of the transmission housing 2.

In the example embodiment of FIG. 6, the pump is provided with a seal flushing arrangement. A seal flushing arrangement may for example be provided to the pump in order to cool or clean the seal area of for example the rotor casing seal 57. A compatible flushing fluid must then be used and supplied at the correct pressure and flow rate. The flush may for example be turned on at the same time or prior to starting the pump, and turned off at the same time or after stopping the pump.

For providing the flushing fluid to the seals, a dedicated rotor casing 15 with integrally formed tubes and first and second flush connections 63, 64 are provided. Such seal flushing arrangement and flushing connections 63, 64 are partly located in the intermediate space 42, but primarily in a region close to the exterior surface of the pump for enabling easy access to said connections 63, 64. However, since the first and second guards 51, 52 are located relatively close to the first and second drive shafts 4, 5, i.e. not in a region close to the exterior surface of the pump, the same guards 51, 52 as used for the pump according to FIG. 1 may be used, thereby reducing the number of different versions of the first and second guards.

Consequently, with reference to FIGS. 1-7, the disclosure concerns a rotary positive displacement pump 1 for pumping a fluid product, wherein the rotary positive displacement pump 1 according to some example embodiments has a front side 17 and a rear side 18 and comprises a transmission housing 2 having an axial front wall 38 and an axial rear wall and providing rotational support to first and second parallel and axially extending drive shafts 4, 5 having gears 6, 7 in constant mesh condition, such that the first and second drive shafts 4, 5 are arranged to rotate in opposite directions. The rotary positive displacement pump 1 further comprises a rotor casing connected to a front side 13 of the transmission housing 2 and having an axial rear wall 20, an axial front wall 22 and a circumferential side wall 21 jointly defining a stationary interior pumping cavity. The rotor casing 15 houses a first rotor 23 that is drivingly connected to the first drive shaft 4 and a second rotor 24 that is drivingly connected to the second drive shaft 5, wherein the first and second rotors 23, 24 are configured for rotating in opposite directions and mutually interacting for providing a positive pumping effect on a fluid product that enters the pumping cavity via a rotor casing inlet 30 and exits the pumping cavity via a rotor casing outlet 31. The axial front wall 38 of the transmission housing 2 and the axial rear wall 20 of the rotor casing jointly define an intermediate space 42 through which the first and second drive shafts 4, 5 extend. The rotary positive displacement pump 1 further comprises a first guard 51 located in said intermediate space 42 and surrounding the first drive shaft 4 for protecting a person from contacting the first drive shaft 4, and a second guard 52 located in said intermediate space 42 and surrounding the second drive shaft 5 for protecting a person from contacting the second drive shaft 5.

Thereby, the first guard 51, or first and second guards 51, 52, may be positioned significantly closer to the first and second drive shafts 4, 5, such that access to seal flushing connections and/or heating/cooling arrangements may be added as optional extra features for certain implementations, all while largely keeping the same guard and all without need for detaching the guard. In other words, by reducing a radial distance between the guard and the first and second drive shafts, and by securing the guard to gearbox in the intermediate space 42 between the transmission housing 2 and rotor casing 15, the need for removing of the guard during operation or minor maintenance procedures is eliminated. The nett result is a more compact, robust and cost-effective design, where fewer guard variants are needed and with reduced risk for operating the pump without having the guard properly installed.

The term "surrounding" used above means that the first guard 51 either substantially or completely surrounds the first drive shaft 4, and that second guard 51 either substantially or completely surrounds the second drive shaft 4. A guard may be deemed substantially surrounding a drive shaft when it surrounds the shaft over at least 75%, specifically at least 90%, of the total perimeter of the drive shaft. In other words, the guard may be deemed surrounding a shaft even if the guard has a relatively small and short gap along its perimeter for any reason.

As schematically illustrated in FIGS. 1, 6 and 7, according to some example embodiments, each of the first and second guards 51, 52 is fastened to the front wall 38 of the transmission housing 2, with or without any intermediate members, such as for example outer end plates 73, 74 as will be described below, depending on the specific circumstances and design of the transmission housing 2.

Furthermore, as schematically illustrated in FIGS. 1, 6 and 7, according to some example embodiments, the first and second guards 51, 52 may have an identical design. In other words, first and second guards 51, 52 may be identical for simplifying manufacturing and reducing cost associated with spare parts handling.

Figure 8:
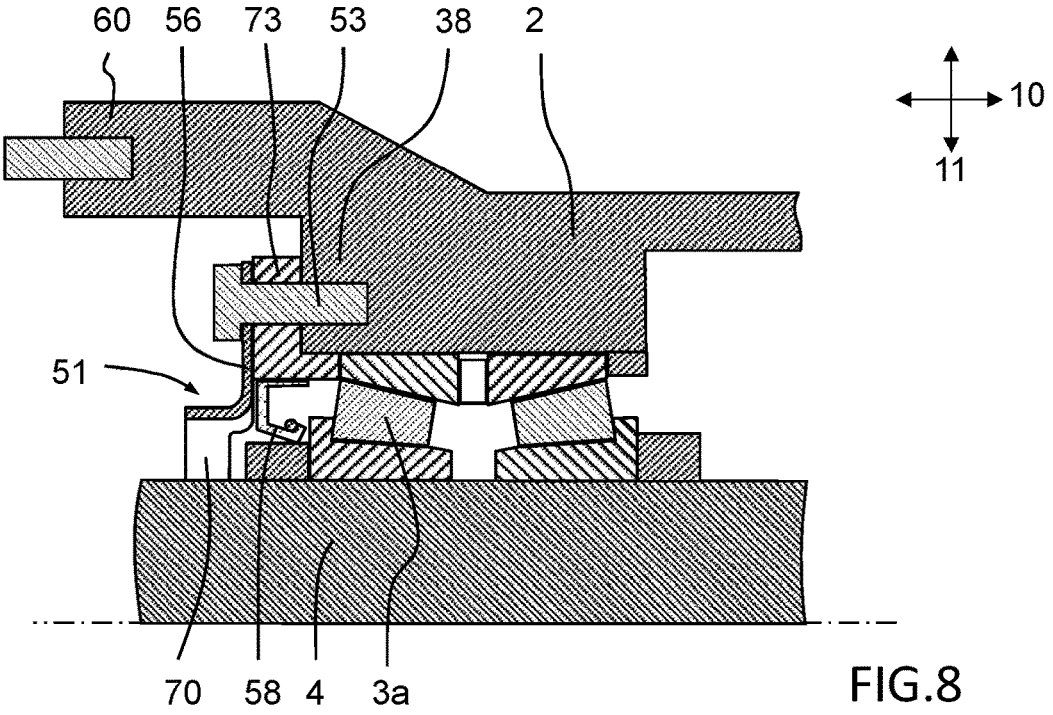
FIG. 8 shows schematically a cross-section of a region of the first guard.

FIG. 8 schematically shows a cross-sectional view of an example embodiment of an attachment region of the first guard 51 to the transmission housing 2.

With reference to FIGS. 1, 7 and 8, according to some example embodiments, each of the first and second guards 51, 52 has an annular protective body 70 with sleeve-like shape and a plurality of attachment devices 56 in form of attachment tabs 56 extending from the annular protective body 70 and clamped to the front wall 38 of the transmission housing 2.

By having the guard and attachment devices 56 made in one piece, i.e. having integral or integrally formed attachment tabs 56, a particularly robust guard is provided. However, the attachment device 56 may alternatively be separate parts used for holding and securing the guard to the transmission housing 2.

In some example embodiments, the first guard 51, or each of the first and second guards 51, 52, is made of curved sheet metal, specifically stainless steel, and includes integral attachment tabs. The guard may thus for example be manufactured by stamping sheet metal to provide a flat work part, which is subsequently rolled or bent to a have a more annular shape. The edges may be welded to form a closed annular guard body, and the integral attachment tabs 56 may be folded outwards to be oriented about perpendicular to an axial direction of the annular guard body.

Consequently, the protective body 70 of the first guard 51, or each of the first and second guards 51, 52 that surrounds the first and/or second drive shafts 4, 5 may be made in one piece.

With reference to FIGS. 1, 7 and 8, in some example embodiments, the rotary positive displacement pump 1 may further comprises a first outer end plate 73 for securing a roller bearing 3*a* of the first drive shaft 4 to the transmission housing 2, and a second outer end plate 74 for securing a roller bearing 3*a* of the second drive shaft to the transmission housing 2, wherein said first and second outer end plates 73, 74 are attached to the transmission housing 2 by means of the same fastening members 53 as used for attaching the first and second guards 51 52 to the transmission housing 2. Thereby, fewer components are needed to further improve cost-efficiency.

Figure 9:
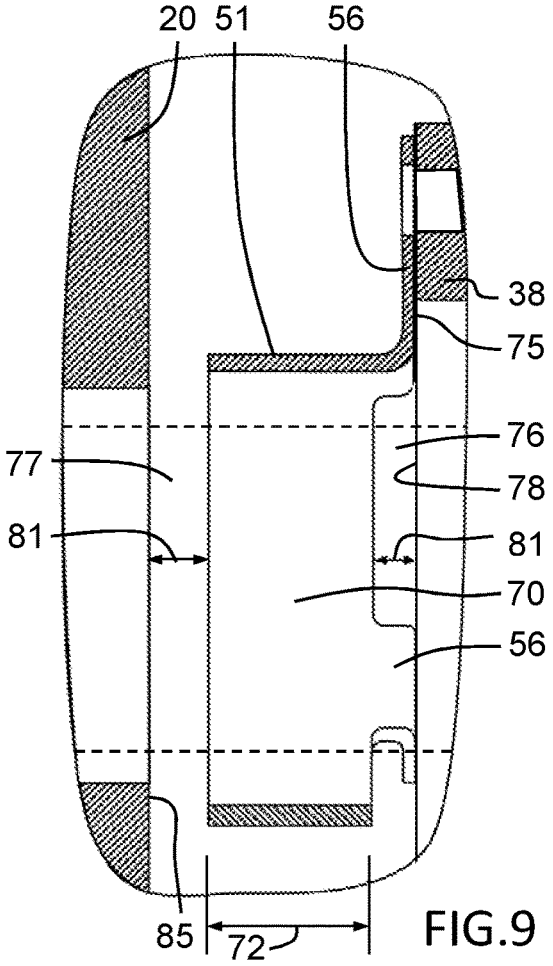
FIG. 9-10 show schematically an example embodiment of the first guard.
Figure 10:
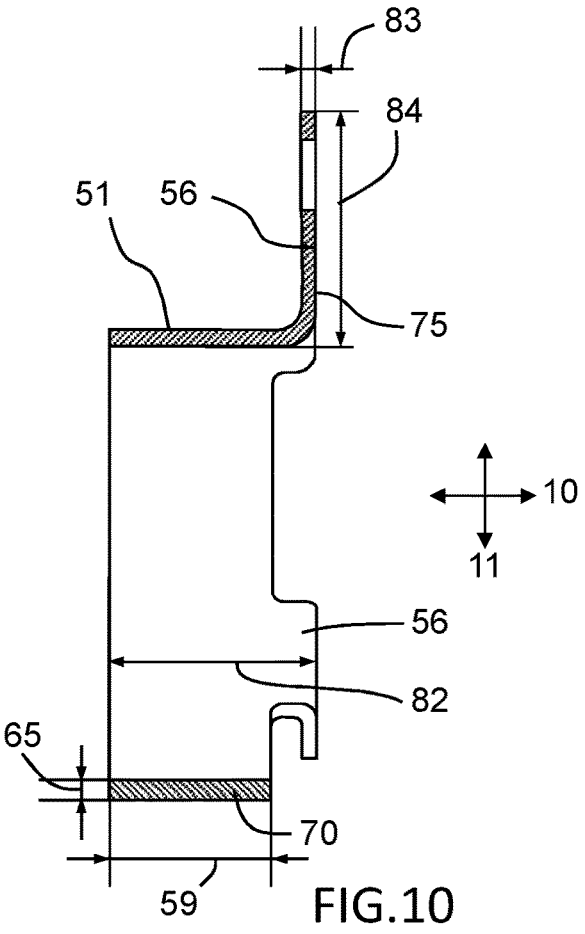

FIG. 9 shows schematically a cross-section of an example embodiment of the first guard 51 in assembled position in relation to the front wall 38 of the transmission housing 2 and rear wall 20 of the rotor casing 15, and FIG. 10 shows the same view but including only the first guard 51.

Each of the first and second guards 51, 52 may according to some example embodiments have an annular body region 70 surrounding the associated drive shaft 4, 5, as well as attachment devices 56, such as for example integral attachment tabs 56, for fastening the annular guard body 70 to the transmission housing. For complying with regulations concerning leak detection from the rotor casing seal 57 or transmission housing seal 58, a complete enclosure of the first and second drive shafts 4, 5 may be undesirable.

Consequently, according to some example embodiments, the annular guard body may be positioned slightly axially displaced from the neighbouring wall surfaces, e.g. the front wall 38 of the transmission housing 2 and the rear wall 20 of the rotor casing 15, because this enables visible detection of any leaks in this region of the pump 1. This axially displaced mounting of the guard body 70 is for example accomplished by having the attachment devices 56 projecting a certain distance axially from the guard body, thereby creating a first axial gap 76 between the guard body 70 and front surface 78 of the wall to which the guard is attached.

Figure 11C:
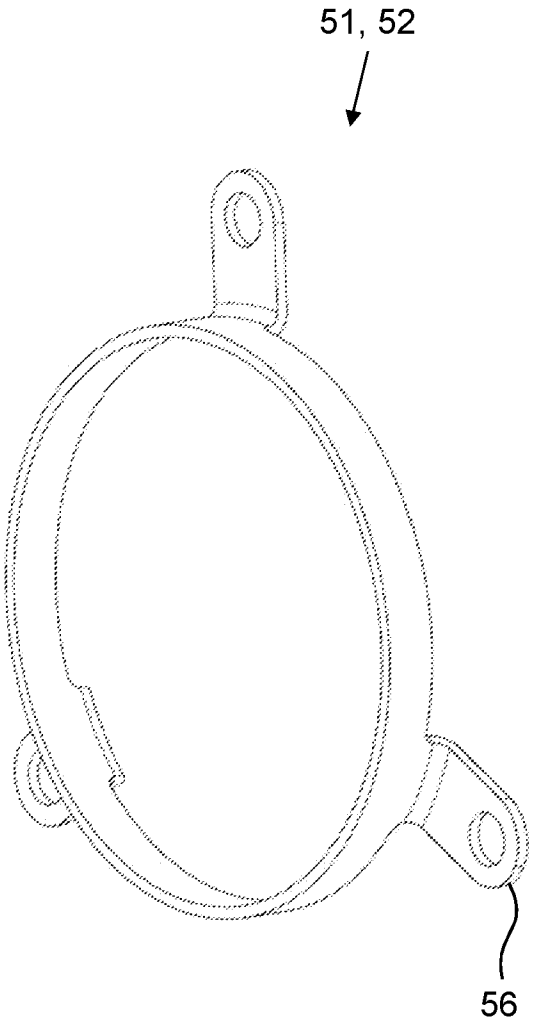
FIG. 11A-C shows schematically three views of an example embodiment of a guard.
Figure 11B:
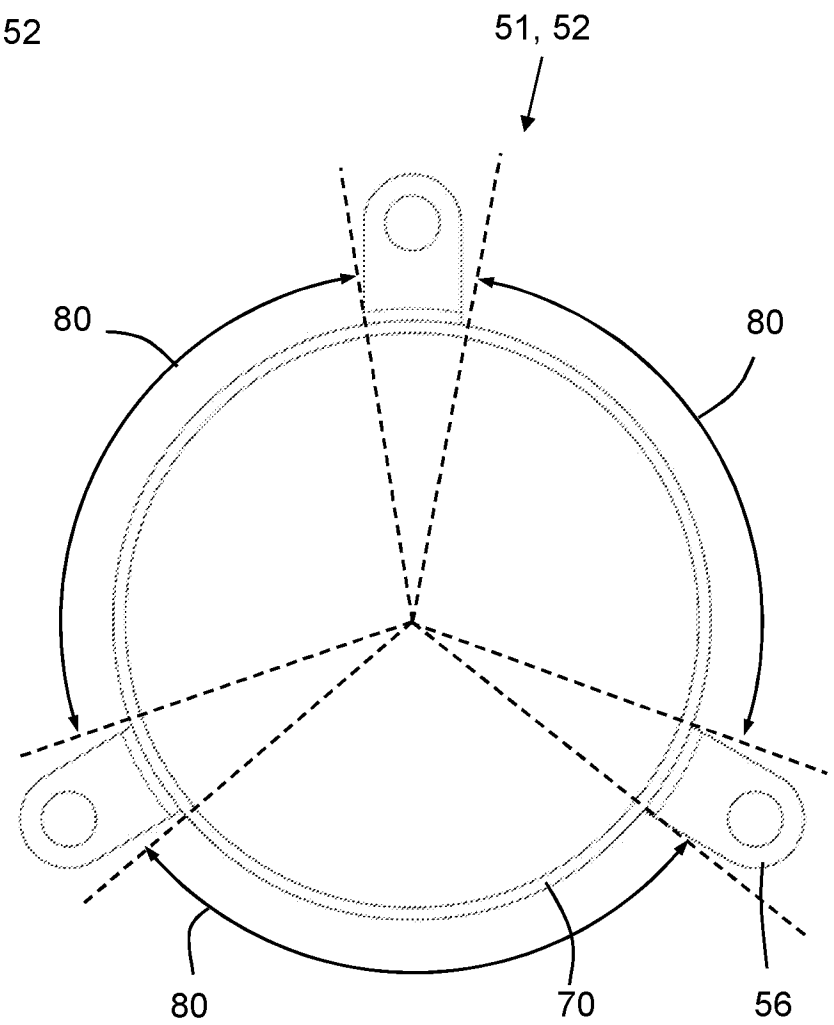
Figure 11A:
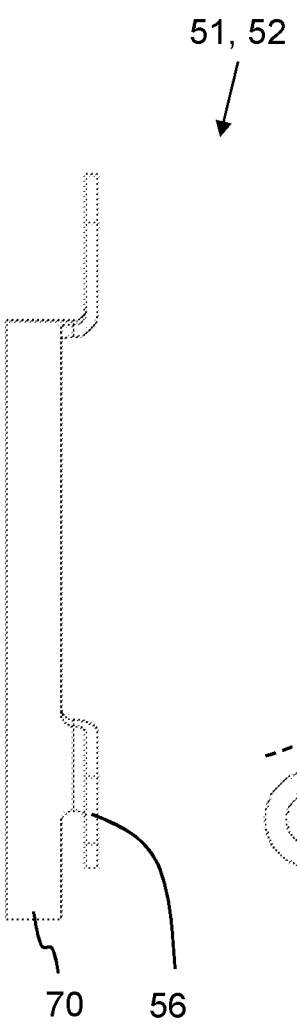

The guard of FIGS. 9 and 10 is further illustrated in various views in FIGS. 11A-11C, and as illustrated in FIG. 11B, said first axial gap 76 extends over certain sections 80 of a total perimeter of the guard 51. In the example embodiment of the guard of FIG. 11B, the first axial gap extends substantially all the way between neighbouring attachment devices 56, thereby extending over at least about 75% of the total perimeter of the guard.

With reference again to FIG. 9, the first guard further define a second axial gap between the guard body and the rear wall 20 of the rotor casing 15 by simply not extending all the way to said rear wall 20.

Consequently, the protective body 70 of each of the first and second guards 51, 52 is axially displaced from the abutment surface 75 of the guard attachment device 56 and/or a rear surface 85 of the rear wall 20 of the rotor casing, in particular over at least a section of about 50% of total perimeter of the associated guard, such that a first axial gap 76 is provided between the protective body 70 and a front surface 78 associated with the front wall 38 of the transmission housing 2, and such that a second axial gap 77 is provided between the protective body 70 and the rear wall 20 of the rotor casing. Thereby, improved visibility of the first and second drive shafts 4, 5 for enabled, as well as improved leakage detection of a fluid product and/or transmission oil from for example a drive shaft seal associated with any of the first and second guards 51, 52.

The first and second axial gaps 76, 77 may have a length 81 of at least 5 millimetres, specifically in the range of 5-10 millimetres, in the axial direction 10 of the pump. This size of the gap may for example extend over at least 25%, specifically over at 50% of a total perimeter of each of the first and second guards 51, 52.

With reference to FIG. 10, a cross-section of each of the first and second guards 51, 52, as seen in a radial direction of the pump and in a region free from a guard attachment device 56, has a length 59 in the axial direction 10 and a thickness 65 in the radial direction, wherein said length 59 is at least three times larger, specifically five times larger, and more specifically at least ten times larger, than said thickness 65.

This cross-section of the first guard 51 that is defined by a length 59 in the axial direction 10 and a thickness 65 in the radial direction corresponds to the annular protective body of the first guard 51.

A total axial length 82 of the first guard 51 here corresponds essentially the axial length 59 of the body of the first guard 51 and the axial length 82 of the first axial gap 76.

The integrally formed attachment tab has in this example embodiment a material thickness 83 of about 0.5-3 mm and a protruding length 84 of about 10-40 mm.

The first and second guards 51, 52 may have various designs, depending on size and dedicated operating conditions, etc. Three different example designs of the first and second guard 51, 52 are schematically illustrated in FIGS. 11A-C, 12A-C and 13A-C.

Figure 12C:
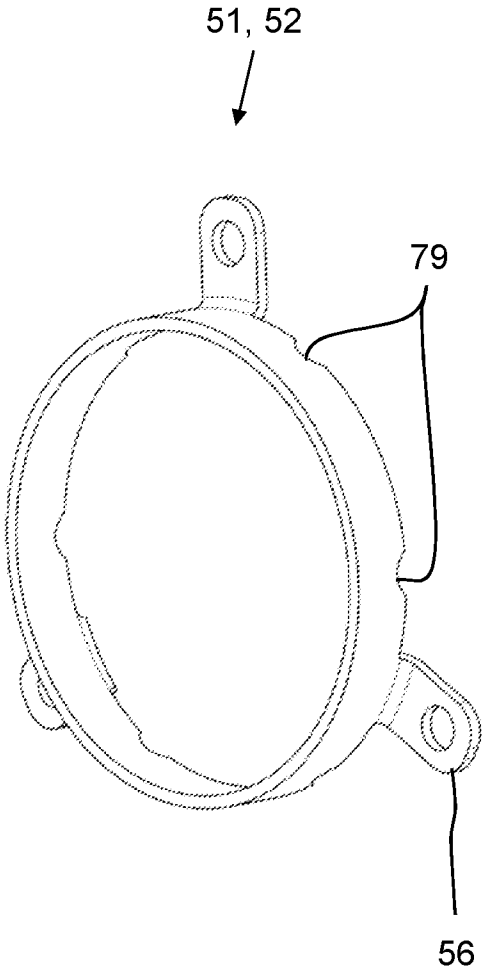
FIG. 12A-C shows schematically three views of a further example embodiment of a guard.
Figure 12B:
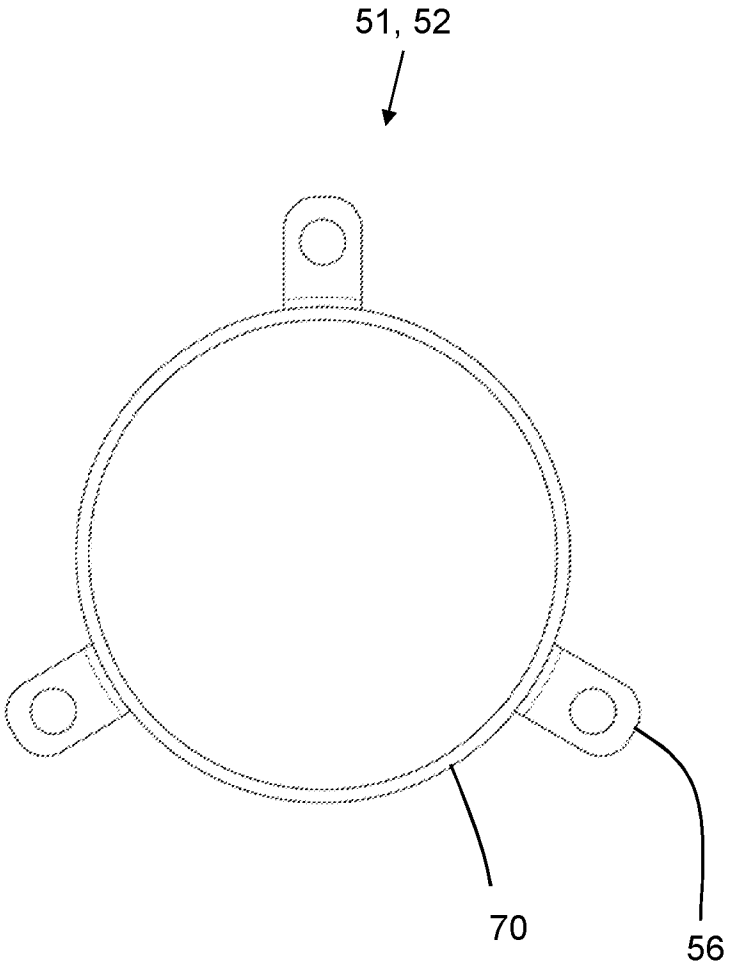
Figure 12A:
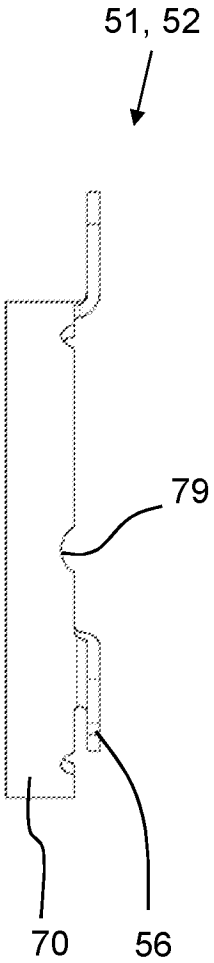

In the example embodiment of FIGS. 12A-C, the protective body 70 of each of the first and second guards 51, 52 comprises recesses 79 for enabling further improved visibility of the first and second drive shafts, and for enabling improved detection of leakage of a fluid product and/or transmission oil at a drive shaft seal associated with the first guard, or any of the first and second guards. As illustrated in FIGS. 12A-C, such recesses 79 may be combined with the first axial gap 76 described above. Alternatively, the first axial gap 76 may be omitted any only recesses 79 may be used.

Figure 13C:
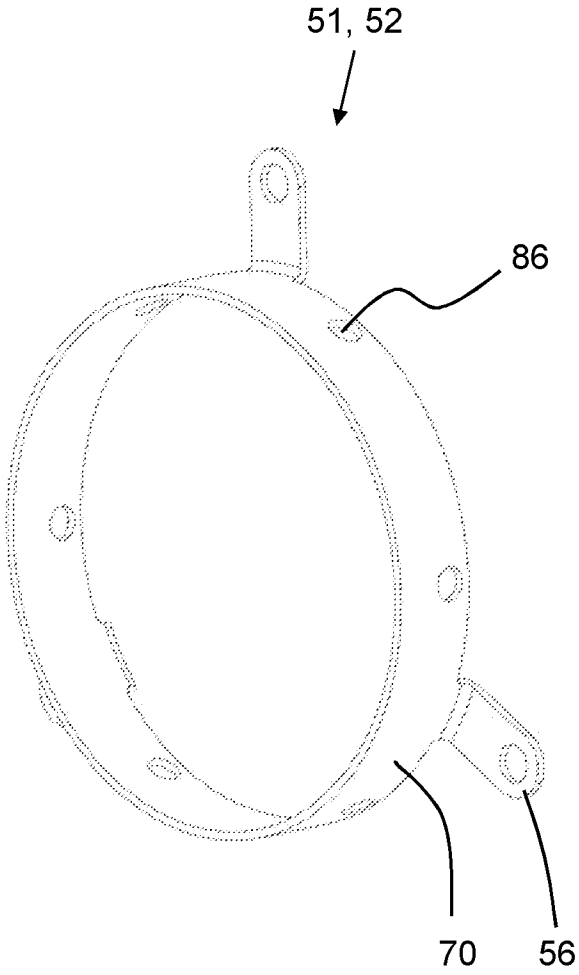
FIG. 13A-C shows schematically three views of still a further example embodiment of a guard.
Figure 13B:
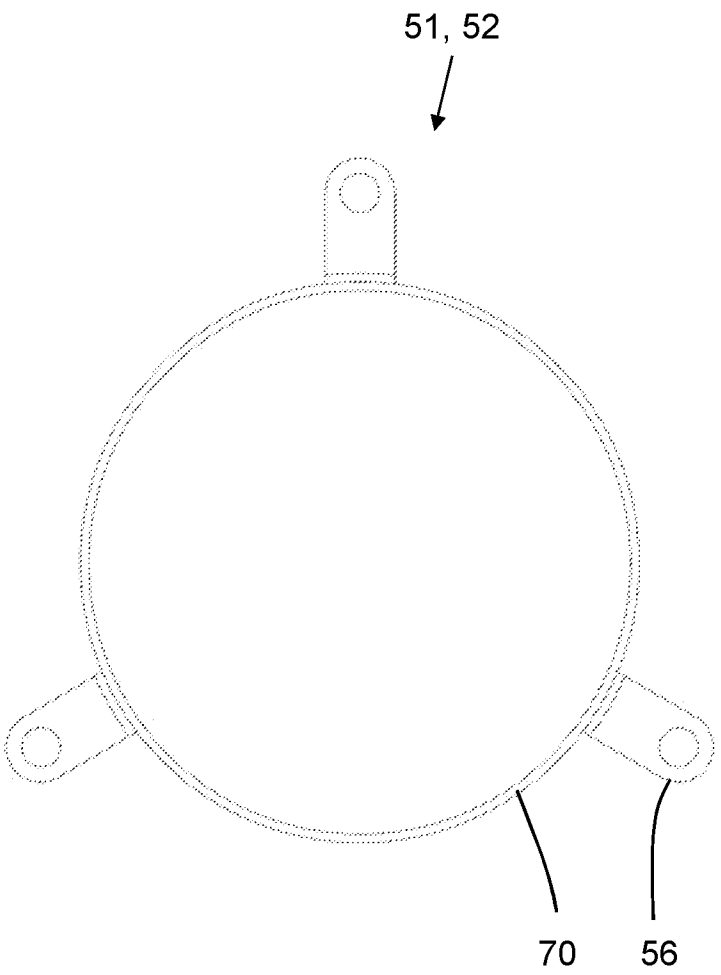
Figure 13A:
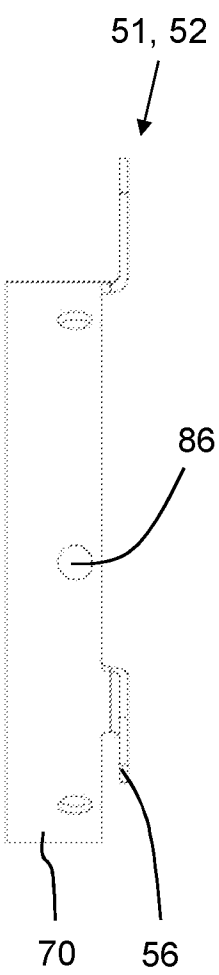

In the example embodiment of FIGS. 13A-C, the protective body 70 of each of the first and second guards 51, 52 comprises through holes 86 for enabling improved visibility of the first and second drive shafts 4, 5 and for enabling improved detection of leakage of a fluid product and/or transmission oil at a drive shaft seal associated with any of the first and second guards 51, 52. As illustrated in FIGS. 13A-C, such holes 86 may be combined with the first axial gap 76 described above. Alternatively, the first axial gap 76 may be omitted any only holes 86 may be used, or holes 86 combined with recesses 79.

Figure 14:
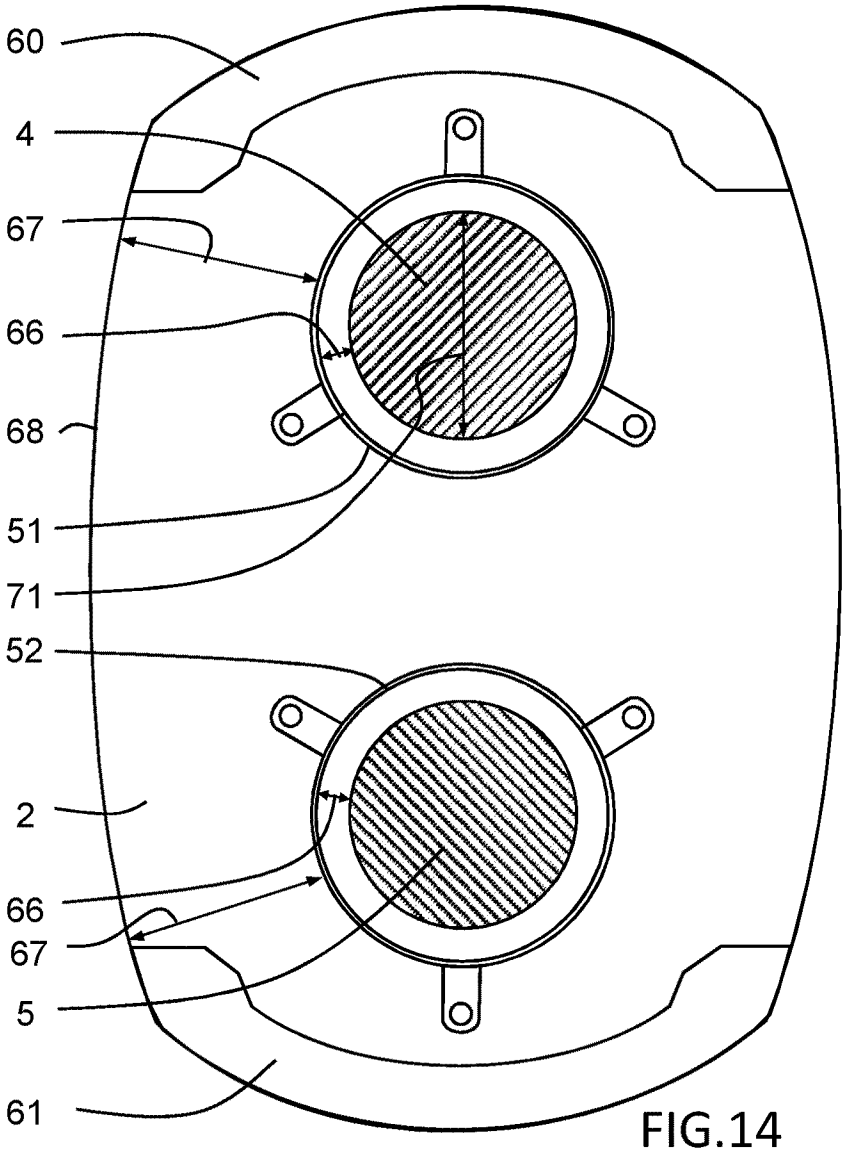
FIG. 14 shows a side view of the transmission housing with drive shafts and first and second guards.

FIG. 14 shows a side view of the transmission housing 2 in the axial direction 10 according to an example embodiment of the pump 1, wherein a radial distance 66 between an outer surface of the first or second drive shaft 4, 5 and a radially outer surface of the protective body 70 of any of the first and second guards 51, 52, over at least 50%, specifically at least 75%, of the circumference of the first and second guards 51, 52, does not exceed 50% of the diameter 71 of the first drive shaft 4, in a axial region 72 where the first guard 51 overlaps with the first drive shaft 4. This is measured in a radial direction normal to the surface of the drive shaft 4, 5.

In other words, the radial distance between the guard and the associated drive shaft is relatively small, thereby providing a compact design where a specific guard is compatible with a large number of pump variants.

Furthermore, with reference again to FIG. 14, in some example embodiments of the pump, a radial distance 67 between an outer surface 68 of the transmission housing 2 and the protective body 20 of any of the first and second guards 51, 52 is larger than 50% of the diameter of the first drive shaft, in an axial region 72 where the first guard 51 overlaps with the first drive shaft 4. This is measured in a radial direction normal to the surface of the guard body 70 of each of the first and second guards 51, 52. Furthermore, this may apply over at least 50%, specifically at least 75%, of the circumference of the first and second guards 51, 52.

In other words, the guard is located spaced apart from the outer surface 68 of the transmission housing 2, thereby providing a compact design where a specific guard is compatible with a large number of pump variants.

Figure 15:
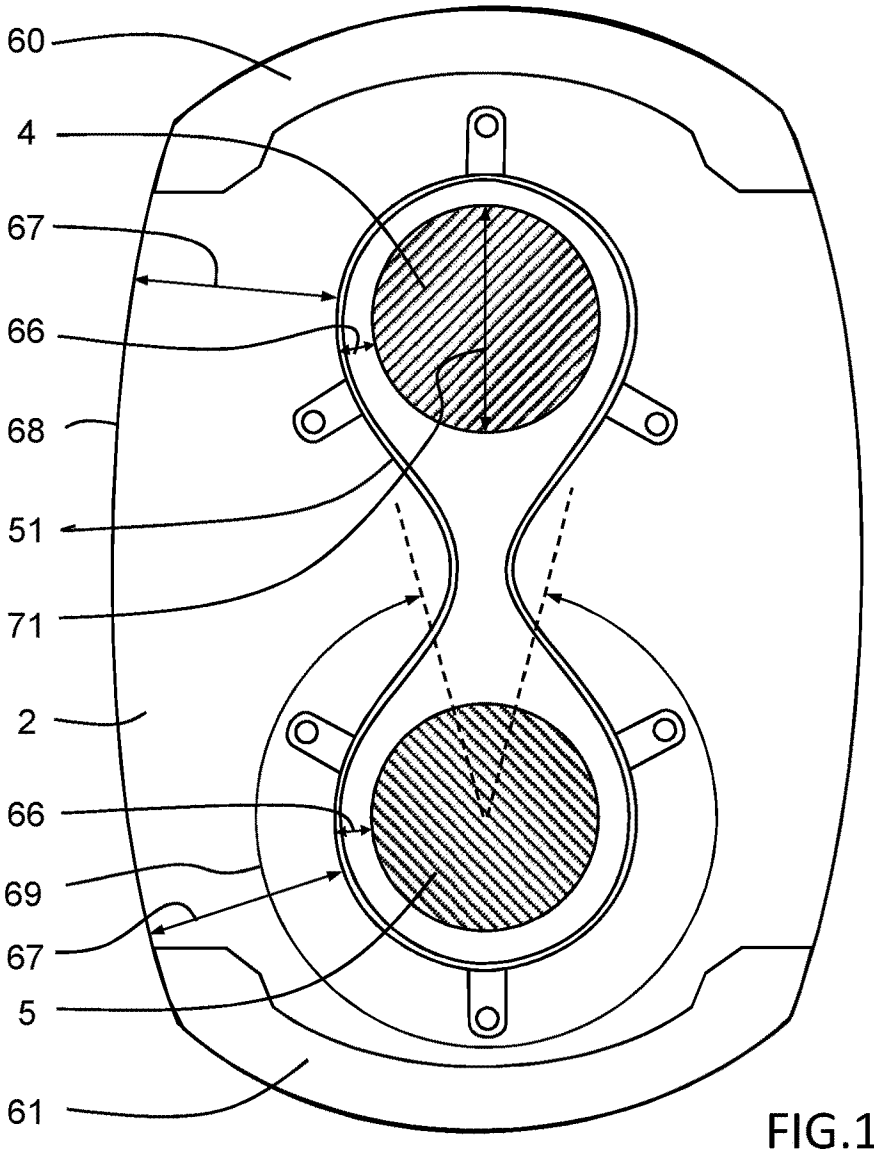
FIG. 15 shows a side view of the transmission housing with a single first guard surrounding both drive shafts.

Furthermore, as schematically illustrated in FIG. 15, the rotary positive displacement pump 1 may according to some example embodiments comprise a single first guard 51 located in said intermediate space and surrounding both the first and second drive shafts 4, 5 for protecting a person from contacting the first and second drive shafts 4, 5. This design may in certain designs of the pump be beneficial in terms of manufacturing, assembly, compactness, etc.

As illustrated in FIG. 15, a single guard may have a generally elliptical shape with or without a narrow central waist. In the example of FIG. 15, the guard may be deemed to have an elliptical shape combined with a strongly narrowed centre region, similar to an hourglass shape, but the narrowing may alternative be less significant.

In addition, although not explicitly illustrated, the protective body 70 of the first guard 51, or each of the first and second guards 51, 52 that surrounds the first and/or second drive shafts 4, 5, may alternatively be made of a plurality of parts, specifically two parts, which are assembled next to each other. This design would potentially allow dismounting of the guard without need for removal of the rotor casing 15.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, modifications may be made to adapt a particular situation or material to the teachings of the present disclosure without departing from the essential scope thereof.

Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims. Reference signs mentioned in the claims should not be seen as limiting the extent of the matter protected by the claims, and their sole function is to make claims easier to understand.

The invention claimed is:

1. A rotary positive displacement pump for pumping a fluid product, the pump having a front side and a rear side and comprising:

a transmission housing having an axial front wall and an axial rear wall and providing rotational support to first and second parallel and axially extending drive shafts having gears in constant mesh condition, such that the first and second drive shafts are arranged to rotate in opposite directions, and a rotor casing connected to a front side of the transmission housing and having an axial rear wall, an axial front wall and a circumferential side wall jointly defining a stationary interior pumping cavity, wherein the rotor casing houses a first rotor that is drivingly connected to the first drive shaft and a second rotor that is drivingly connected to the second drive shaft, wherein the first and second rotors are configured for rotating in opposite directions and mutually interacting for providing a positive pumping effect on a fluid product that enters the pumping cavity via a rotor casing inlet and exits the pumping cavity via a rotor casing outlet, wherein the axial front wall of the transmission housing and the axial rear wall of the rotor casing jointly define an intermediate space through which the first and second drive shafts extend, and wherein the rotary positive displacement pump further comprises:

a first guard located in said intermediate space and surrounding the first and second drive shafts for protecting a person from contacting the first and second drive shafts, or a first guard located in said intermediate space and surrounding the first drive shaft for protecting a person from contacting the first drive shaft, and a second guard located in said intermediate space and surrounding the second drive shaft for protecting a person from contacting the second drive shaft, wherein a protective body of the first guard, or each of the first and second guards, is axially displaced from an abutment surface of a guard attachment device, such that a first axial gap is provided between the protective body and a front surface associated with the front wall of the transmission housing, and/or from a rear surface of the rear wall of the rotor casing, such that a second axial gap is provided between the protective body and the rear wall of the rotor casing, for enabling improved visibility of the first and second drive shafts, and for enabling improved detection of leakage of a fluid product and/or transmission oil at a drive shaft seal associated with the first guard, or any of the first and second guards.

2. The rotary positive displacement pump according to claim 1, wherein the first guard, or each of the first and second guards, is made of curved stainless steel.

3. The rotary positive displacement pump according claim 1, wherein the first guard, or each of the first and second guards, is fastened to the front wall of the transmission housing.

4. The rotary positive displacement pump according to claim 1, wherein the first guard, or each of the first and second guards, is fastened to the front wall of the transmission housing by a plurality of fastening members, having their longitudinal direction arranged parallel with an axial direction of the first and second drive shafts.

5. The rotary positive displacement pump according to claim 1, wherein a cross-section of the first guard, or each of the first and second guards, as seen in a radial direction of the pump and in a region free from a guard attachment device, has a length in the axial direction and a thickness in the radial direction, wherein said length is at least three times larger than said thickness.

6. The rotary positive displacement pump according to claim 1, wherein a radial distance between an outer surface of the first or second drive shaft and a radially outer surface of a protective body of the first guard, or any of the first and second guards, over at least 50% of the circumference of the first guard or first and second guards, does not exceed 50% of a diameter of the first drive shaft, in an axial region where the first guard overlaps with the first drive shaft.

7. The rotary positive displacement pump according to claim 1, wherein a radial distance between an outer surface of the transmission housing and a protective body of the first guard, or any of the first and second guards, is larger than 50% of the diameter of the first drive shaft, in an axial region where the first guard overlaps with the first drive shaft.

8. The rotary positive displacement pump according to claim 1, wherein a protective body of the first guard, or each of the first and second guards that surrounds the first and/or second drive shafts is made in one piece, or wherein a protective body of the first guard, or each of the first and second guards that surrounds the first and/or second drive shafts is made of a plurality of parts, specifically two parts, which are assembled next to each other to form an annular guard.

9. A rotary positive displacement pump for pumping a fluid product, the pump having a front side and a rear side and comprising:

a transmission housing having an axial front wall and an axial rear wall and providing rotational support to first and second parallel and axially extending drive shafts having gears in constant mesh condition, such that the first and second drive shafts are arranged to rotate in opposite directions, and a rotor casing connected to a front side of the transmission housing and having an axial rear wall, an axial front wall and a circumferential side wall jointly defining a stationary interior pumping cavity, wherein the rotor casing houses a first rotor that is drivingly connected to the first drive shaft and a second rotor that is drivingly connected to the second drive shaft, wherein the first and second rotors are configured for rotating in opposite directions and mutually interacting for providing a positive pumping effect on a fluid product that enters the pumping cavity via a rotor casing inlet and exits the pumping cavity via a rotor casing outlet, wherein the axial front wall of the transmission housing and the axial rear wall of the rotor casing jointly define an intermediate space through which the first and second drive shafts extend, and wherein the rotary positive displacement pump further comprises:

a first guard located in said intermediate space and surrounding the first and second drive shafts for protecting a person from contacting the first and second drive shafts, or a first guard located in said intermediate space and surrounding the first drive shaft for protecting a person from contacting the first drive shaft, and a second guard located in said intermediate space and surrounding the second drive shaft for protecting a person from contacting the second drive shaft, wherein the rotary positive displacement pump further comprises a first outer end plate for securing a roller bearing of the first drive shaft to the transmission housing, and a second outer end plate for securing a roller bearing of the second drive shaft to the transmission housing, wherein said first and second outer end plates are attached to the transmission housing by fastening members used for attaching the first guard, or the first and second guards, to the transmission housing.

10. The rotary positive displacement pump according to claim 9, wherein a protective body of the first guard, or each of the first and second guards, is axially displaced from an abutment surface of a guard attachment device, such that a first axial gap is provided between the protective body and a front surface associated with the front wall of the transmission housing, and/or from a rear surface of the rear wall of the rotor casing, such that a second axial gap is provided between the protective body and the rear wall of the rotor casing, for enabling improved visibility of the first and second drive shafts, and for enabling improved detection of leakage of a fluid product and/or transmission oil at a drive shaft seal associated with the first guard, or any of the first and second guards.

11. The rotary positive displacement pump according to claim 1, wherein each of the first and second axial gaps is at least 5 millimetres.

12. A rotary positive displacement pump for pumping a fluid product, the pump having a front side and a rear side and comprising:

a transmission housing having an axial front wall and an axial rear wall and providing rotational support to first and second parallel and axially extending drive shafts having gears in constant mesh condition, such that the first and second drive shafts are arranged to rotate in opposite directions, and a rotor casing connected to a front side of the transmission housing and having an axial rear wall, an axial front wall and a circumferential side wall jointly defining a stationary interior pumping cavity, wherein the rotor casing houses a first rotor that is drivingly connected to the first drive shaft and a second rotor that is drivingly connected to the second drive shaft, wherein the first and second rotors are configured for rotating in opposite directions and mutually interacting for providing a positive pumping effect on a fluid product that enters the pumping cavity via a rotor casing inlet and exits the pumping cavity via a rotor casing outlet, wherein the axial front wall of the transmission housing and the axial rear wall of the rotor casing jointly define an intermediate space through which the first and second drive shafts extend, and wherein the rotary positive displacement pump further comprises:

a first guard located in said intermediate space and surrounding the first and second drive shafts for protecting a person from contacting the first and second drive shafts, or a first guard located in said intermediate space and surrounding the first drive shaft for protecting a person from contacting the first drive shaft, and a second guard located in said intermediate space and surrounding the second drive shaft for protecting a person from contacting the second drive shaft wherein a protective body of the first guard, or each of the first and second guards, comprises recesses and/or through holes for enabling improved visibility of the first drive shaft or first and second drive shafts, and for enabling improved detection of leakage of a fluid product and/or transmission oil at a drive shaft seal associated with the first guard, or any of the first and second guards.

13. The rotary positive displacement pump according to claim 1, wherein the first and second guards have identical design.

14. The rotary positive displacement pump according to claim 1, wherein the first guard, or each of the first and second guards, has a protective body and a plurality of guard attachment devices extending from the protective body.

15. The rotary positive displacement pump according to claim 1, wherein each of the first and second guards has an annular protective body with sleeve-like shape and a plurality of guard attachment devices extending from the annular protective body and clamped to the front wall of the transmission housing or an intermediate member.

16. The rotary positive displacement pump according to claim 1, wherein the first guard, or each of the first and second guards, is made of curved stainless steel and includes integral attachment tabs.

17. The rotary positive displacement pump according to claim 1, wherein a cross-section of the first guard, or each of the first and second guards, as seen in a radial direction of the pump and in a region free from a guard attachment device, has a length in the axial direction and a thickness in the radial direction, wherein said length is at least ten times larger than said thickness.

18. A rotary positive displacement pump for pumping a fluid product, the pump having a front side and a rear side and comprising:

a transmission housing having an axial front wall and an axial rear wall and providing rotational support to first and second parallel and axially extending drive shafts having gears in constant mesh condition, such that the first and second drive shafts are arranged to rotate in opposite directions;

a rotor casing connected to a front side of the transmission housing and having an axial rear wall, an axial front wall and a circumferential side wall jointly defining a stationary interior pumping cavity;

the transmission housing including an attachment portion that projects away from the axial front wall in a forward direction and terminates at a forward end of the attachment portion;

the rotor casing housing a first rotor that is drivingly connected to the first drive shaft and a second rotor that is drivingly connected to the second drive shaft;

the first and second rotors being configured for rotating in opposite directions and mutually interacting for providing a positive pumping effect on a fluid product that enters the pumping cavity via a rotor casing inlet and exits the pumping cavity via a rotor casing outlet;

the axial front wall of the transmission housing and the axial rear wall of the rotor casing jointly defining an intermediate space through which the first and second drive shafts extend; and the rotary positive displacement pump further comprising a guard located in the intermediate space and surrounding the first drive shaft to protect a person from contacting the first drive shaft, the guard having a forward end and a rear end, the rear end of the guard being closer to the axial front wall of the transmission housing than the forward end of the guard, the forward end of the attachment portion being positioned forward of the forward end of the guard in the forward direction so that the forward end of the attachment portion is closer to the axial rear wall of the rotor casing than the forward end of the guard.

19. A rotary positive displacement pump for pumping a fluid product, the pump having a front side and a rear side and comprising:

a transmission housing having an axial front wall and an axial rear wall and providing rotational support to first and second parallel and axially extending drive shafts having gears in constant mesh condition, such that the first and second drive shafts are arranged to rotate in opposite directions, and a rotor casing connected to a front side of the transmission housing and having an axial rear wall, an axial front wall and a circumferential side wall jointly defining a stationary interior pumping cavity, wherein the rotor casing houses a first rotor that is drivingly connected to the first drive shaft and a second rotor that is drivingly connected to the second drive shaft, wherein the first and second rotors are configured for rotating in opposite directions and mutually interacting for providing a positive pumping effect on a fluid product that enters the pumping cavity via a rotor casing inlet and exits the pumping cavity via a rotor casing outlet, wherein the axial front wall of the transmission housing and the axial rear wall of the rotor casing jointly define an intermediate space through which the first and second drive shafts extend; and a guard located in the intermediate space and surrounding the first drive shaft to protect a person from contacting the first drive shaft, the guard being separate from the transmission housing and being fastened to the transmission housing by a fastener that is separate from the guard and the transmission housing and that engages both a part of the guard as well as a part of the transmission housing.

* * * * *